US005706839A

United States Patent [19]

Patti

[11] Patent Number: 5,706,839

[45] Date of Patent: Jan. 13, 1998

[54] DIRECT APPLICATION

[76] Inventor: Josie Ann Patti, 160 Yucatan Dr., Pensacola, Fla. 32506

[21] Appl. No.: 797,846

[22] Filed: Feb. 10, 1997

[51] Int. Cl.[6] ..... A45D 8/20

[52] U.S. Cl. ..... 132/277; 132/212; 132/207; 132/208; 401/10

[58] Field of Search ..... 132/277, 116, 132/109, 207, 212, 208, 112, 231, 108; 401/10, 196

[56] References Cited

U.S. PATENT DOCUMENTS

| | | | |
|---|---|---|---|
| 2,463,611 | 3/1949 | Green et al. | 401/10 |
| 2,660,182 | 11/1953 | Kaul | 132/109 |
| 2,705,499 | 4/1955 | Breeze | 132/109 |
| 2,761,459 | 9/1956 | Kaul | 132/109 |
| 4,830,030 | 5/1989 | Busch et al. | 132/212 |
| 5,325,878 | 7/1994 | McKay | 132/108 |

*Primary Examiner*—Gene Mancene
*Assistant Examiner*—Pedro Philogene
*Attorney, Agent, or Firm*—Joseph H. McGlynn; Patent & Trademark Services, Inc.

[57] ABSTRACT

An applicator of liquid products, such as dyes, to hair in exact quantities and locations. The applicator is composed of a traditional alligator-style hair clip with two mutually opposed members connected by a spring mechanism. Mounted on one end of the upper member of the alligator-style clip is a membrane designed to hold the liquids for hair treatment. When filled with the liquids, the membrane is pressured, thereby forcing the liquid out of the membrane through holes located in the membrane, which then transports the liquid to the surrounding hair.

9 Claims, 1 Drawing Sheet

FIG. 1
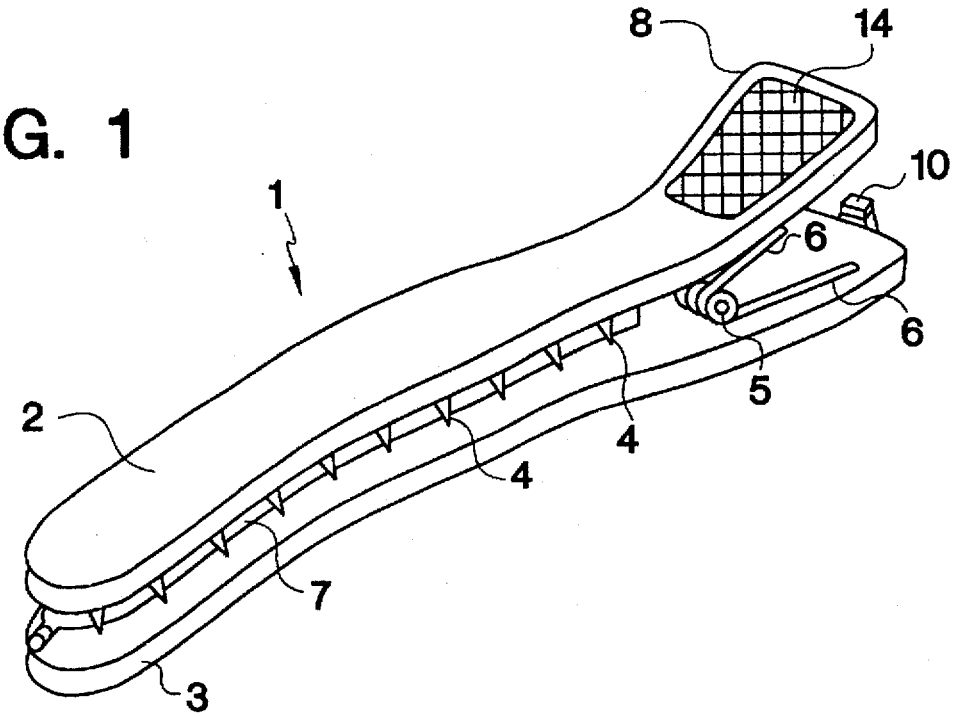
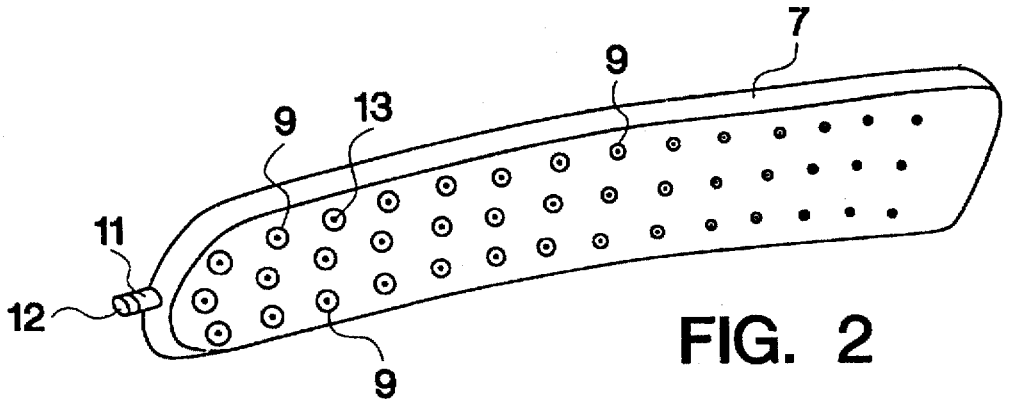
FIG. 2
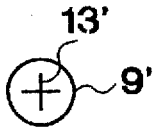
FIG. 3

DIRECT APPLICATION

BACKGROUND OF THE INVENTION

This invention relates generally to liquid applicators and, more particularly, to liquid applicators combined with hair clips.

DESCRIPTION OF THE PRIOR ART

Numerous inventions relating to hair clip liquid applicators have been proposed in the prior art. Often, they seek to allow the application of liquid chemicals, such as dyes, to the user's hair through a mechanism contained within a hair clip apparatus. U.S. Pat. No. 2,463,611 discloses an applicator for permanent waving lotions and other liquids, including a container for the liquids that is closed with a removable stopper the liquids are delivered from the container into a sponge portion inside a spring hair clip, and then to the hair via holes located in the clip. A valve controls passage from the container to the sponge portion.

U.S. Pat. No. 5,325,878 discloses a fluid dispensing comb for applying a fluid to the hair having a body upon which a plurality of teeth are formed such that they are configured to have a V-shape, thereby defining a groove. An absorbent pad is disposed within the groove defined by the teeth and functions as a reservoir and application means for containing and dispensing a fluid such as hair oil, coloring, or conditioner to the hair. Thus, the dispensing comb of the present invention provides a simple and convenient means for applying fluids to the hair whereby the user avoids directly contacting the fluid with the hands.

U.S. Pat. No. 2,705,499 discloses an applicator which can be held in one hand and used to apply liquid, such as hair waving solution, to tresses of hair guided by the applicator. The invention has mutually opposed liquid-applying bodies detachably mounted thereon, so that the bodies can be squeezed together to regulate the amount of liquid carried thereby and avoiding spilling or dripping of the liquid, and can be removed from the applicator for cleaning or replacement when desired.

U.S. Pat. No. 4,830,030 discloses an applicator for hair treating liquids comprising a hair clip in which one or more such liquids are expressed through mutually opposed linings in the jaw face.

Most of the prior art inventions have allowed hair treatment liquids to be applied directly to the hair without direct contact with the user's hands, but without allowing control of the volume and rate of dispersal to the hair of the liquids. There remains a need, therefore, for a device which allows the application of liquids to the hair through a traditional hair clip, while allowing control of the rate and volume of liquid application.

SUMMARY OF THE INVENTION

The present invention comprises a means for the application of liquid products, such as dyes, to hair in exact quantities and locations. The invention is composed of a traditional alligator-style hair clip with two mutually opposed members connected by a spring mechanism, the upper member of which has a plurality of holes. Mounted on one end of the upper member of the alligator-style clip is a membrane designed to hold the liquids for hair treatment. When filled with the liquids, the membrane is pressured, thereby forcing the liquid out of the membrane through a hole located between the membrane and the upper clip of the alligator-style hair clip.

Accordingly, it is an object of this invention to allow the application to hair of liquids, such as dyes and hair treatments.

It is a further object of this invention that the applicator be in the form of a conventional hair clip, thereby allowing control of the location of application, as well as freeing the user from coming into contact with the liquids.

Finally, it is an object of this device that the applicator have as a feature a mechanism for controlling the volume of liquid applied to the hair that may be easily employed by the user.

BRIEF DESCRIPTION OF THE DRAWINGS

FIG. 1 shows a perspective view of the invention.

FIG. 2 shows a perspective view of one of the bladders of the present invention.

FIG. 3 shows a plan view of another embodiment of the nozzles used with the bladders of the present invention.

DESCRIPTION OF THE PREFERRED EMBODIMENT

Referring now to the drawings, there is shown in FIG. 1 the present invention 1 comprising a conventional alligator-style hair clip consisting of a mutually opposed upper 2 and lower 3 clip piece connected by a coil spring mechanism 5 which has a pair of straight portions 6 which engage the upper and lower clip pieces 2, 3, to normally hold the clips in a closed position. A hollow membrane 7 is attached to the upper clip piece 2 on the side facing the lower clip piece 3. The membrane 7 can be a separate piece which is attached to the clip piece 2 by any conventional fastening means such as, but not limited to, gluing. In addition, it could be molded as a unitary part of the clip piece 2 during manufacture.

On the side of the upper clip piece 2 facing the lower clip piece 3 is a plurality of small pointed gripping teeth 4 oriented so that the bases of the pointed pieces 4 are attached to the upper clip piece 2 and the pointed ends are directed towards the lower clip piece 3. The teeth 4 are arranged to be attached to the outer circumference of the upper clip piece 2, and the bladder 7 will be received within the circle of teeth.

The spring 5 is any conventional metal or plastic coil spring and is in the form of a continuous coil with ends 6 extended away from the coil in the same direction. One of the ends 6 emanates from the top of the coil and the other from the bottom of the coil, as shown in FIG. 1. The ends 6 engage both the upper 2 and lower 3 clip pieces and thereby hold the front of the clip pieces in a normally closed position.

At the back end of the clip pieces 2, 3 are handle areas 8 which have a rough surface 14 which will facilitate the squeezing of the back ends of the clips together in order to separate the clips for a purpose to be described below. In addition, at the back end of lower clip piece 3 is a latch 10 which will snap over the top of clip 2 when the clips are squeezed together in order to hold the clips in an open position.

The hollow membrane 7 is shown in FIG. 2 and it has a filling tube 11, through which various types of hair treatment liquids may be introduced into the membrane 7. A cap 12, which can be a snap on cap or a screw threaded cap, will close the filling tube after it has been filled.

Spaced along the bottom surface of the membrane is a plurality of nozzles 9. The nozzles 9 are semi-circular depressions in the surface of the membrane and are of varying sizes, as shown in FIG. 2, with the smallest located nearest to the back of the membrane 7 and the largest located toward the front of the membrane 7. The number of nozzles can be varied for different sizes of clips. For example the clip shown in FIG. 2 would be a "large" clip which would be used for hair of a particular length. If the user had shorter hair, a smaller clip could be used. The smaller clip would be the same as shown in FIG. 2 except it would have fewer rows of nozzles. Normally, the clips would come in four sizes: jumbo, large, medium and small, however, other sizes could be used without departing from the scope of the invention.

At the center of each nozzle 9 is an aperture 13 which will allow the liquid inside the membrane to exit the membrane and fill into the semi-circular depressions of the nozzle 9. The apertures 13 could be a small, circular aperture, or it could be a small cross-shaped opening 13', as shown in FIG. 3. The material the membrane is made from should be a self sealing material similar to the material which is used to seal medical bottles from which a liquid is removed with a hypodermic needle.

In use, The clip pieces 2, 3 are squeezed by the handle portions 8 until the latch 10 engages and locks the clips in an open position. The membrane 7 is filled with a liquid for hair treatment through the hollow portion 11. Once the membrane 7 is filled, the plug piece or cap 12 is placed on the hollow portion 11 so that no liquid may escape from the membrane 7, except through the apertures 13, 13' in the nozzles 9, 9'. The latch 10 is then released and the hair clip assembly 1 is placed in the hair in the same manner as any conventional hair clip, in the region that is to be treated with the liquid. The gripping teeth 4 hold the hair in the desired position as the spring 5 squeezes the two clip pieces 2,3 together. The torquing force of the spring 5 is transmitted through the end pieces 6 to the clips 2,3, thereby pushing apart the back end of the clips 2,3. This internal force is then transmitted through the clips 2,3, thereby pushing the clips 2,3 together at the front end and pushing the gripping teeth 4 toward the lower clip piece 3, helping to further secure hair.

The user then applies pressure to the outside of the clip pieces 2, 3, which applies pressure to the membrane 7 thereby forcing the liquid, out of the membrane 7 via the small opening 13, 13'. As liquid is forced away from the membrane 7, the increasing size of the holes 9 counters the decreasing pressure, thereby assuring that the liquid is dispersed evenly along the length of the upper clip 2. The user ceases to apply pressure to the membrane 7 and removes the clip 1 from the hair when a desired amount of liquid treatment has been dispensed to the hair, or when all liquid has been expunged from the membrane.

The composition of the invention 1 is largely dependent upon the function of each part of the device. The body of the device 1, including the clip pieces 2,3 is best produced of injection molded plastic.

Injection molding is a plastic molding procedure whereby heat softened plastic material is forced under very high pressure into a metal cavity mold which is relatively cool. Acceptable metals for the mold are aluminum and steel. The inside cavity of the mold is comprised of two or more halves, and is the same desired shape as the product to be formed. High pressure hydraulics are used to keep the mold components together during the actual injection phase of the molding process. The injected plastic is allowed to cool and harden. The hydraulics holding the multiple component cavity together are released, the halves of the mold are separated and the solid formed plastic item is removed. Injection molding can be a highly automated process and is capable of producing extremely detailed parts at a very cost effective price.

The membrane 7 is to be formed of clear, flexible, polyethylene plastic by a blow molding process. Blow molding is an inexpensive process which uses a parison (hollow tube) of plastic, and at minimum a two part mold. The hollow plastic tube (parison) is heat softened and a cavity (within the two part mold) is placed around the tube. The mold pinches off one end of the tube while hot air is blown into the other end of the plastic tube. The tube "blows up" like a balloon against the mold. This means that the blown plastic takes on the shape of the mold it was formed against. The two part mold is then opened up and the article ejected and allowed to cool and harden. Second stage cutting and trimming follows to give the part a finished look. Some of the second stage work is performed by hand while other portions may be done by machine depending on the exact nature of the part being worked on. Most blow molders like to use polyethylene plastic because it has a waxy feel to it and slides well within the mold, although other materials may be used. Textures may be added to the outer surface of a blow molded part, giving the appearance of leather, grainy sand, cross-hatching, etc. Textures such as these would certainly add to the overall quality appearance of the membrane 7.

The connections between the various pieces in this device may be accomplished in many different ways. Perhaps the simplest option is a strong adhesive or glue which binds the plastic pieces together, though adjacent parts might also be connected as continuous pieces or by cutting appropriate recesses to allow connections to be secured by friction.

Although the hair clip assembly and the means of using the same according the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. An applicator for applying hair treatment fluids, comprising:

a first clip piece having a front portion, a top surface, a bottom surface and a rear portion, manipulating means attached adjacent said rear portion, a second clip piece having a front portion, a top surface, a bottom surface and a rear portion, manipulating means attached adjacent said rear portion, means for pivotably connecting said first and second clip pieces together, one of said first and second clip pieces having a plurality of teeth attached to said bottom surface, one of said first and second clip pieces having a bladder attached thereto for holding hair treatment fluids, said bladder means having at least one aperture for allowing said hair treatment fluids to exit said bladder.

2. The applicator for applying hair treatment fluids as claimed in claim 1, wherein said means for pivotably connecting said first and second clip pieces together is a coil spring which normally holds said clip pieces with their front ends closed.

3. The applicator for applying hair treatment fluids as claimed in claim 1, wherein said manipulating means have roughened surfaces.

4. The applicator for applying hair treatment fluids as claimed in claim 1, wherein said rear portions of one of said clip pieces has a latch means attached thereto, said latch means engaging said other of said clip pieces to hold said front portions of said first and second clips pieces open.

5. The applicator for applying hair treatment fluids as claimed in claim 1, wherein said at least one aperture in said bladder is surrounded by a semi-circular depression.

6. The applicator for applying hair treatment fluids as claimed in claim 1, wherein said bladder means has a plurality of apertures.

7. The applicator for applying hair treatment fluids as claimed in claim 6, wherein said apertures are arranged in a plurality of rows.

8. The applicator for applying hair treatment fluids as claimed in claim 6, wherein said apertures are each surrounded by a semi-circular depression, and some of said semi-circular depressions are larger in diameter than others.

9. The applicator for applying hair treatment fluids as claimed in claim 8, wherein said semi-circular depressions are arrange with the larger depressions placed adjacent said front portion of said clip, and the smaller depressions placed adjacent said rear portion of said clip.

* * * * *